US006467894B1

(12) United States Patent
Misumi

(10) Patent No.: US 6,467,894 B1
(45) Date of Patent: Oct. 22, 2002

(54) INK JET PRINT APPARATUS AND PRINT METHOD USING THE SAME

(75) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/022,013

(22) Filed: Feb. 11, 1998

(30) Foreign Application Priority Data

Feb. 14, 1997 (JP) ..... 9-030132

(51) Int. Cl.[7] ..... B41J 2/01
(52) U.S. Cl. ..... 347/101
(58) Field of Search ..... 347/20, 34, 37, 347/95, 96, 98, 101, 65, 39

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,345,263 A | * | 8/1982 | Tazaki et al. | 347/37 |
| 4,369,450 A | * | 1/1983 | Iwagami et al. | 347/34 |
| 4,459,600 A | | 7/1984 | Sato et al. | |
| 4,463,359 A | | 7/1984 | Ayata et al. | |
| 4,538,160 A | | 8/1985 | Uchiyama | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,549,740 A | * | 8/1996 | Takahashi et al. | 106/20 R |
| 5,992,968 A | * | 11/1999 | Uetsuki et al. | 347/37 |

FOREIGN PATENT DOCUMENTS

| | | | | |
|---|---|---|---|---|
| DE | 3638885 | * | 5/1988 | 347/20 |
| EP | 0 540 987 | | 5/1993 | |
| EP | 0 730 367 | | 9/1996 | |
| EP | 0 730 961 | | 9/1996 | |
| JP | 54-56847 | | 5/1979 | |
| JP | 56-58876 | | 5/1981 | |
| JP | 59-123670 | | 7/1984 | |
| JP | 59-138461 | | 8/1984 | |
| JP | 60-71260 | | 4/1985 | |
| JP | 3-292145 | | 12/1991 | |
| JP | 7-178897 | | 7/1995 | |
| JP | 8-72234 | | 3/1996 | |
| JP | 8-295022 | | 11/1996 | |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A print apparatus carries out printing by allowing an ink and a processing liquid that makes the ink insoluble to deposit on a printing medium in such a way that they are deposited on each other on a printing medium. A head that ejects the ink or processing liquid and the printing medium are relatively moved in a primary scanning direction. A processing liquid droplet and a black ink droplet are sequentially ejected at the same positions in the direction opposite to the relative moving direction from the respective ejection ports provided at a predetermined space in the relative moving direction on the head. This configuration allows a splashing liquid droplet caused by a subsequent black ink droplet depositing on the processing liquid droplet previously depositing on the printing medium at a position, to be ejected in the direction opposite to the relative moving direction of the head and the printing medium, thereby preventing the splashing liquid droplet from splashing on a face of the head to deposit thereon.

9 Claims, 5 Drawing Sheets

INK JET PRINT APPARATUS AND PRINT METHOD USING THE SAME

This application is based on patent application No. 30132/1997 filed Feb. 14, 1997 in Japan, the content of which is incorporated hereinto by reference.

BACKGROUND OF THE INVENTION

1. Field of the Invention

The present invention relates to an ink jet print apparatus and method for ejecting inks to form ink liquid droplets and depositing them on a printing medium such as paper for printing, and in particular, to a configuration for preventing an ink jet head from inappropriately ejecting inks due to the splashing of ejected liquid droplets occurring on the printing medium.

2. Description of the Related Art

Due to the use of non-impact printing method, ink jet print apparatuses have various advantages such as low noise during printing and fast printing, and are gathering attention due to their ability to provide significantly saturated color images. In such ink jet print apparatuses which use thermal energy to eject inks, since the ink jet head can be manufactured using processes similar to those for semiconductor devices, the size of the apparatus can be easily reduced, while the number and density of orifices used can be easily increased.

Printing color images using such ink jet print apparatuses has many advantages. A plurality of types of inks, for example, yellow, magenta, cyan, and black corresponding to colors to be printed are generally ejected from heads for the respective inks in such a way that these inks are deposited on one another substantially at the same position on the printing medium in order to form desired color dots.

In addition, to improve the water-proofness of printed images and print grade, the present applicant has proposed a print apparatus that ejects a processing liquid (also referred to as a printing quality improvement liquid) that makes the color material in an ink insoluble or aggregation in such a way that the liquid is deposited on the ink. This configuration can mix the ink with the processing liquid on the printing medium to make the color material such as a dye in the ink insoluble in order to improve water-proofness. It can also prevent the ink from bleeding and increase the concentration to improve the print grade.

If, however, color printing is performed as described above or the processing liquid is used, a subsequent ink or the processing liquid deposits in a overlay manner on a liquid droplet of an ink or the processing liquid that is precedently deposited on the printing medium and that is permeating therein, so splashing is more likely to occur and a larger amount of liquid droplets splashes than in the case where an ink droplet is deposited on the printing medium without depositing a precedent or leading ink. Such splashing droplets or processing liquid droplets, or splashing liquid droplets into which an ink and the processing liquid are mixed together, deposit on the face (in which ejection ports are disposed) of the ink jet head like mists, thereby deflecting the ejection direction or preventing ejection which affects the grade of the images.

In particular, if splashing liquid droplets in which an ink and the processing liquid are mixed together deposit on the face, they become insoluble on the face and cannot be easily removed by recovery processing, such as wiping or preliminary ejection, resulting in a critical ejection error.

It is a first object of this invention to provide an ink jet print apparatus that can prevent ejection errors by reducing the amount of splashing liquid droplets of an ink or the processing liquid that are deposited on a face of the ink jet head, including an ink or processing liquid ejection port.

In addition, it is a second object of this invention to provide an ink jet print apparatus that can prevent ejection errors by reducing the amount of splashing liquid droplets of an ink or the processing liquid that are deposited on the face of the ink jet head.

SUMMARY OF THE INVENTION

The first object is to provide an ink jet print apparatus for printing and can be achieved by one aspect of this invention using an ink jet head that ejects a liquid from at least two ejection ports to allow liquids sequentially ejected from the at least two ejection ports, as the ink jet head and a printing medium are relatively moved to deposit on the printing medium in such a way that the liquids are deposited on one another on the printing medium, wherein a velocity vector of the liquid ejected from at least one of the at least two ejection ports has a component of the velocity vector in the direction opposite to the relative moving direction of the ink jet head and the printing medium.

Here, the velocity vector of a subsequent one of the liquids sequentially ejected from the at least two ejection ports may have a larger component of the velocity vector in the direction opposite to the relative moving direction than a velocity vector component of a leading liquid.

The second object is to provide an ink jet print apparatus for printing and can be achieved by a second aspect of this invention using an ink jet head that ejects a liquid from at least two ejection ports in order to allow liquids sequentially ejected from the at least two ejection ports as the ink jet head and a printing medium are relatively moved to deposit on the printing medium in such a way that the liquids are deposited on one another on the printing medium, wherein a velocity vector of the liquid ejected from at least one of the at least two ejection ports has a component of the velocity vector in the direction opposite to the relative moving direction of the ink jet head and the printing medium.

Here, the velocity vector of a subsequent one of the liquids sequentially ejected from the at least two ejection ports may have a larger component of the velocity vector in the direction opposite to the relative moving direction than a velocity vector of a leading liquid.

According to this invention, at least one of the velocity vectors of the liquids sequentially ejected from the at least two ejection ports in the ink jet head as the ink jet head is scanned has a component of the velocity vector in the direction opposite to the relative moving direction. Thus, the direction in which the subsequently ejected liquid is ejected can be tilted toward the direction opposite to the relative moving direction relative to the printing medium, thereby enabling a splashing liquid droplet caused by the depositing on an already deposited liquid droplet of the subsequent liquid droplet, to be directed away from the ink jet head.

The above and other objects, effects, features, and advantages of the present invention will become more apparent from the following description of embodiments thereof taken in conjunction with the accompanying drawings.

DETAILED DESCRIPTION OF PREFERRED EMBODIMENTS

Embodiments of this invention are described below with reference to the drawings.

First Embodiment

Figure 1:
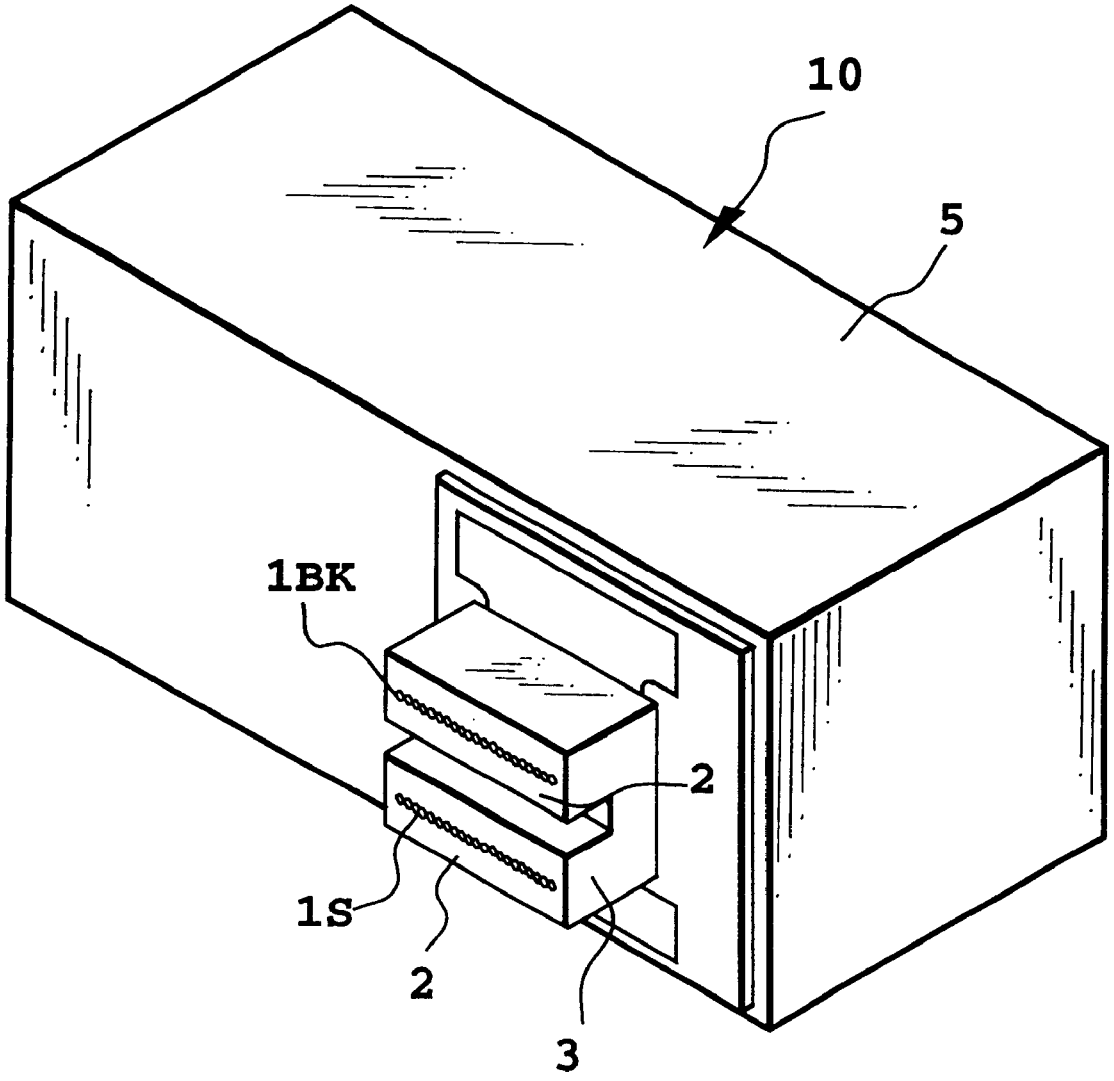
FIG. 1 is a perspective view showing one embodiment of an ink jet cartridge that can be installed in an ink jet print apparatus according to this invention.
Figure 2:
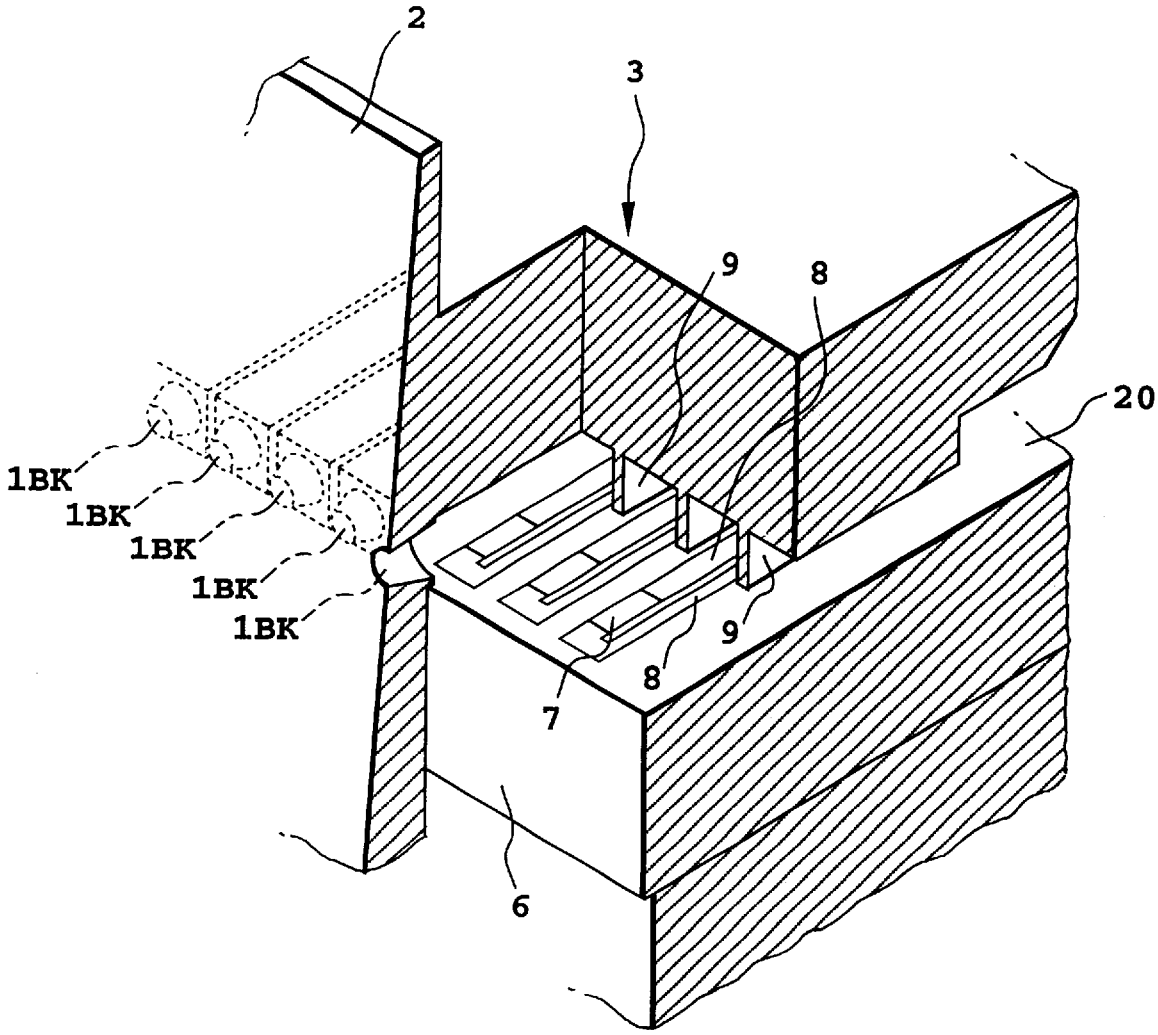
FIG. 2 is a perspective view showing in a partial cross section the internal structure of an ink jet head constituting the ink jet cartridge shown in FIG. 1.

FIG. 1 shows an ink jet cartridge that can be installed in an ink jet print apparatus according to this invention and that consists of an ink jet head and an ink tank. FIG. 2 is a perspective view showing in a partial cross section a portion relating to one of the ejection port arrays in the ink jet head shown in FIG. 1. Furthermore, FIG. 3 is a perspective view showing an ink jet print apparatus in which the ink jet cartridge is detachably mounted.

As shown in FIG. 1, an ink jet cartridge 10 comprises an ink jet head 3 and ink tank 5 that are integrally formed. The ink jet head 3 has two ejection port arrays; each ejection port 1BK in one of the arrays ejects a black ink while each ejection port 1S in the other array ejects a processing liquid (also referred to as a "printing quality improvement liquid") that makes the dye in the black ink insoluble or aggregation. That is, the ink jet head 3 is structurally divided into two parts, each of which is driven for independent ejection. In addition, the ink tank 5 has two chambers therein for storing, for example, a black ink and the processing liquid.

FIG. 2 shows in detail the structure of that portion of the ink jet head 3 shown in FIG. 1 which ejects the black ink, and the portion for ejecting the processing liquid has a similar structure. An ink supplied from the ink tank 5 is filled in the common liquid chamber 20 and each ink path 9 which is provided corresponding to each ejection port 1BK and is continuously supplied to the ink path 9 for ejection from the common liquid chamber 20 as the ink is ejected. In each ink path 9, a print signal, that is, an electric signal from a head drive circuit is applied to a heater 7 via an electrode 8, and then the heater 7 is heated to apply thermal energy to the ink present in the ink path 9 near the heater 7. The application of thermal energy subjects the ink to film boiling to generate bubbles, the pressure of which causes the ink to be ejected from the ejection port 1BK. The ejection port 1BK is structured in such a way that an ink ejection direction V'3 is at a predetermined angle instead of 90° from a face 2. The predetermined angle is described in detail in FIG. 5. The processing liquid is ejected using a similar structure and a similar principle.

Figure 3:
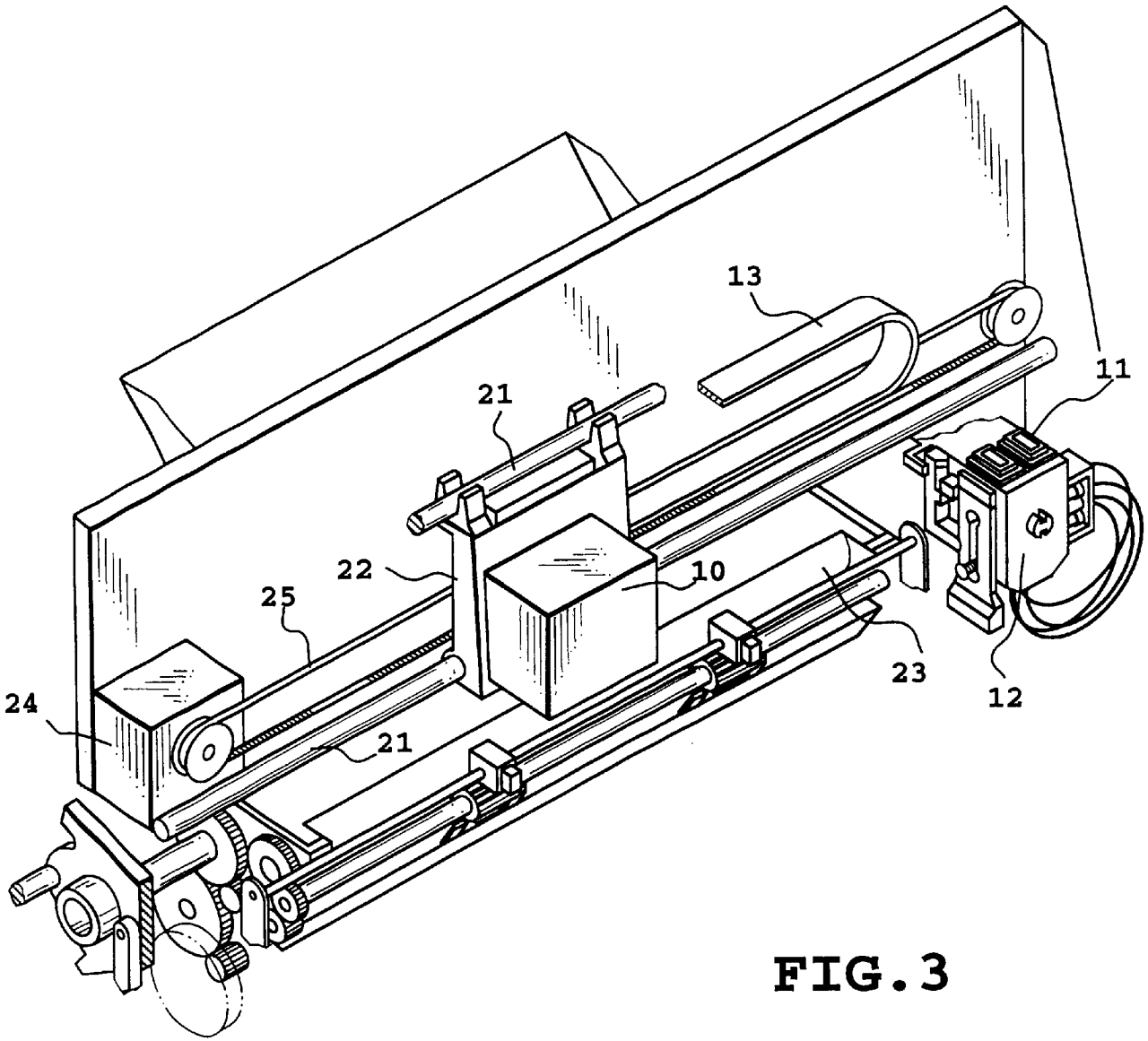
FIG. 3 is a perspective view showing one embodiment of the ink jet print apparatus according to this invention.

The ink jet cartridge is detachably mounted in the ink jet print apparatus shown in FIG. 3. That is, the ink jet cartridge 10 is detachably mounted on a carriage 22, while the carriage 22 can be moved for scanning by means of driving by a carriage motor 24 transmitted via a belt 25 while being guided by two guide shafts 21. In this embodiment, although only the carriage 22 mounting the ink jet cartridge 10 thereon is reciprocally scanned in a primary direction along a longitudinal direction of the two guide shafts 21, the carriage 22 and a printing paper P as a printing medium may be relatively moved in the primary direction.

As the carriage 22 is moved, the print signal is transferred to the ink jet head 10 from an apparatus control section via a flexible printed circuit board 13 and based on this signal, the head is driven as described above and printing is performed through ink ejection. In this case, the processing liquid deposits on that predetermined position on the printing paper P on which, for example, a black ink droplet deposits. According to this invention, the processing liquid does not need to deposit on all specified positions on the printing paper P on which the black ink deposits, the specified effects of this invention can be obtained if the processing liquid droplet is deposited only on some of the depositing positions. In addition, either the black ink or the processing liquid may be ejected first. In either case, this invention is applicable even if the contents of a splashing liquid droplet are different.

Two caps 11 that contact the face 2 of the head 3 to cap each of the 2 ejection port arrays are provided at one end of the moving range of the ink jet cartridge 10. A recovery pump 12 is connected to the caps 11 to provide a negative pressure in a closed space consisting of the face 2 and the caps 11 in order to suck the ink or processing liquid in the ejection port 1BK and the ink path 9 in communication with the ejection port, thereby performing suction recovery processing that eliminates blinding.

In the ink jet head 3 of the apparatus, the two ejection port arrays almost perpendicular to the primary scanning direction are disposed in parallel at an interval of 1.27 cm with the plurality of ejection ports of each array disposed at an interval of 42.5 $\mu$m. Fifteen nano-grams per droplet of the processing liquid is ejected from the ejection ports in the first array. On the other hand, 30 nano-grams per droplet of the black ink is ejected from the ejection ports in the second array.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 $\mu$m in pore size (tradename: fuloropore filter manufactured by Sumitomo Electric Industries, Ltd.), and thereafter, pH of the mixture is adjusted to a level of 4.8 by adding sodium hydroxide whereby liquid A1 can be obtained.

[Components of A1]

| | |
|---|---|
| low molecular weight ingredients of cationic compound; | |
| stearyl-trimethyl ammonium salts (tradename : Electrostriper QE, manufactured by Kao Corporation), or stearyl-trimethyl ammonium chloride (tradename : Yutamine 86P, manufactured by Kao Corporation) | 2.0 parts by weight |

-continued

| | |
|---|---|
| high molecular weight ingredients of cationic compound; | |
| copolymer of diarylamine hydrochloride and sulfur dioxide (having an average molecular weight of 5000) (tradename : polyaminesulfon PAS-92, manufactured by Nitto Boseki Co., Ltd) | 3.0 parts by weight |
| thiodiglycol; | 10 parts by weight |
| water | balance |

Preferable examples of ink which becomes insoluble by mixing the aforementioned processing liquid can be noted below.

Specifically, the following components are mixed together, the resultant mixture is pressure-filtered with the use of a membrane filter of 0.22 μm in pore size (tradename: Fuloroporefilter, manufactured by Sumitomo Electric Industries, Ltd.) so that yellow ink Y1, magenta ink M1, cyan ink C1 and black ink K1 can be obtained.

[Yellow Ink Y1]

| | |
|---|---|
| C. I. direct yellow 142 | 2 parts by weight |
| thiodiglycol | 10 parts by weight |
| acetynol EH (tradename manufactured by Kawaken Fine Chemical Co., Ltd.) | 0.05 parts by weight |
| water | balance |

[Magenta Ink M1]

having the same composition as that of Y1 other than that the dyestuff is changed to 2.5 parts by weight of C. I. acid red 289.

[Cyan Ink C1]

having the same composition as that of Y1 other than that the dyestuff is changed to 2.5 parts by weight of acid blue 9.

[Black ink K1]

having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art, or even if there is the need to use them, it is sufficient that they are assistantly used to improve an effect of the present invention, and the quantity of usage of them can be minimized. As a result, the fact that there is no reduction of a property of color exhibition, which is a problem in the case where the effect of water resistibility is attainted by using the conventional cationic high molecular weight material and the polyvalent metallic salts, can be noted as another effect of the present invention.

With respect to a printing medium usable for carrying out the present invention, there is no specific restriction, so called plain paper such as copying paper, bond paper or the like conventionally used can preferably be used. Of course, coated paper specially prepared for ink jet printing and OHP transparent film are preferably used. In addition, ordinary high quality paper and bright coated paper are preferably used.

Before explaining ink ejection according to this embodiment, for comparison, the condition of ink ejection according to a conventional ink jet print apparatus, which was observed by the present inventor's experiment, is described with reference to FIG. 4. The ink jet head 3 is driven at a drive frequency of 9.6 kHz, so if dots are formed at a density of 600 dpi on a printing medium 1.5 mm away from the ink jet head 3 in the primary scanning direction, then at position A in the figure, a processing liquid droplet 16 is ejected from the first ejection port array 14 in the perpendicular direction relative to the head at an ejection velocity V1 (12 m/s) and, 125 μsec later, the liquid droplet deposits at position X on the printing medium P. Then, 31250 μsec after the ejection of the processing liquid droplet 16, the head is moved over the spacing distance between the first ejection port array 14 and the second ejection port array 15, and at the same position as the first ejection port array 14 that has ejected the processing liquid droplet 16, a black ink droplet 17 is ejected from the second ejection port array 15 in the same direction as the processing liquid droplet at an ejection velocity V1 (12 m/s). At 125 μsec after the ejection from the second ejection port 15, the liquid droplet deposits on the printing medium P at position X on the processing liquid 16. Position A shown in FIG. 4 shows the condition of the ejection of the black ink droplet 17 from the second ejection port array 15, and the chain line in FIG. 4 shows the mutual locational relationship between the two ejection port arrays 14 and 15 formed in the face 2 as seen from the printing medium P.

Figure 4:
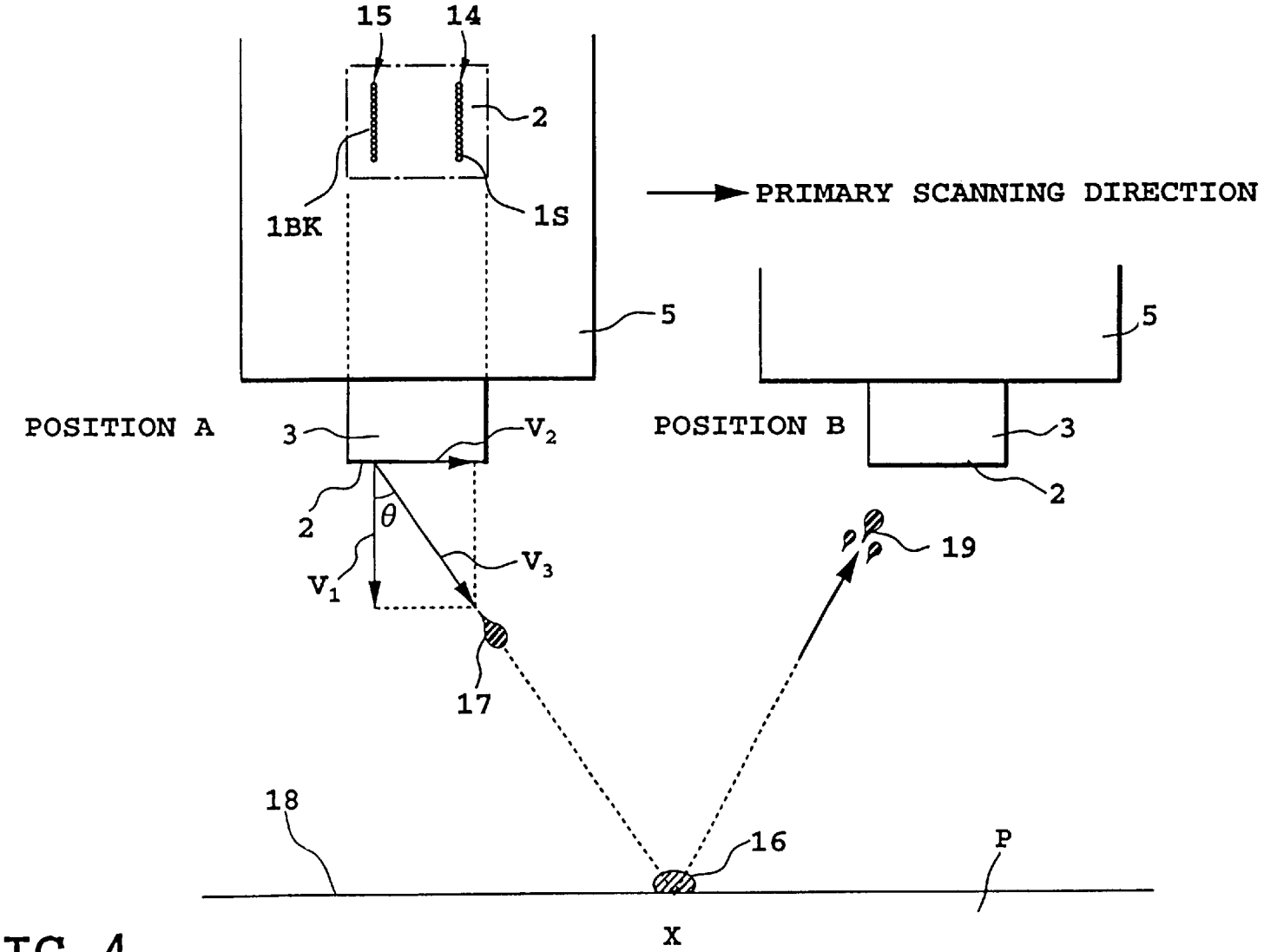
FIG. 4 PRIOR ART
FIG. 4 is a front view describing the behavior of a splashing liquid droplet in a conventional ink jet print apparatus if an ink and a processing liquid that makes the ink insoluble are ejected in such a way that they are deposited on each other.

In this case, since the drive frequency is 9.6 kHz, the moving velocity of the head during printing is 0.4064 m/s, which corresponds to the carriage velocity V2 shown in FIG. 4. In addition, V1 is an ejection velocity of 12 m/s and V3 is an ejection velocity and direction relative to the printing medium P which can be obtained by synthesizing the two velocities V1 and V2. In this case, θ=1.9°, as seen in FIG. 4.

Position B shown in FIG. 4 shows the condition after the black ink droplet 17 has deposited on the processing liquid droplet 16. That is, when the black ink droplet 17 deposits on the processing liquid droplet 16 at position X at an incidence angle of (90°~θ)=88.1°, the ink (or the ink into which the processing liquid is mixed) splashes at a reflection angle of 88.1°, which is the same as the incidence angle. The splashing droplet 19 deposits on the face 2 of the head 3 that is scanning with a trace shown in the figure.

The configuration of this embodiment for eliminating the deposition of splashing droplets on the head 3 in the illustrated conventional apparatus is described with reference to FIG. 5.

Figure 5:
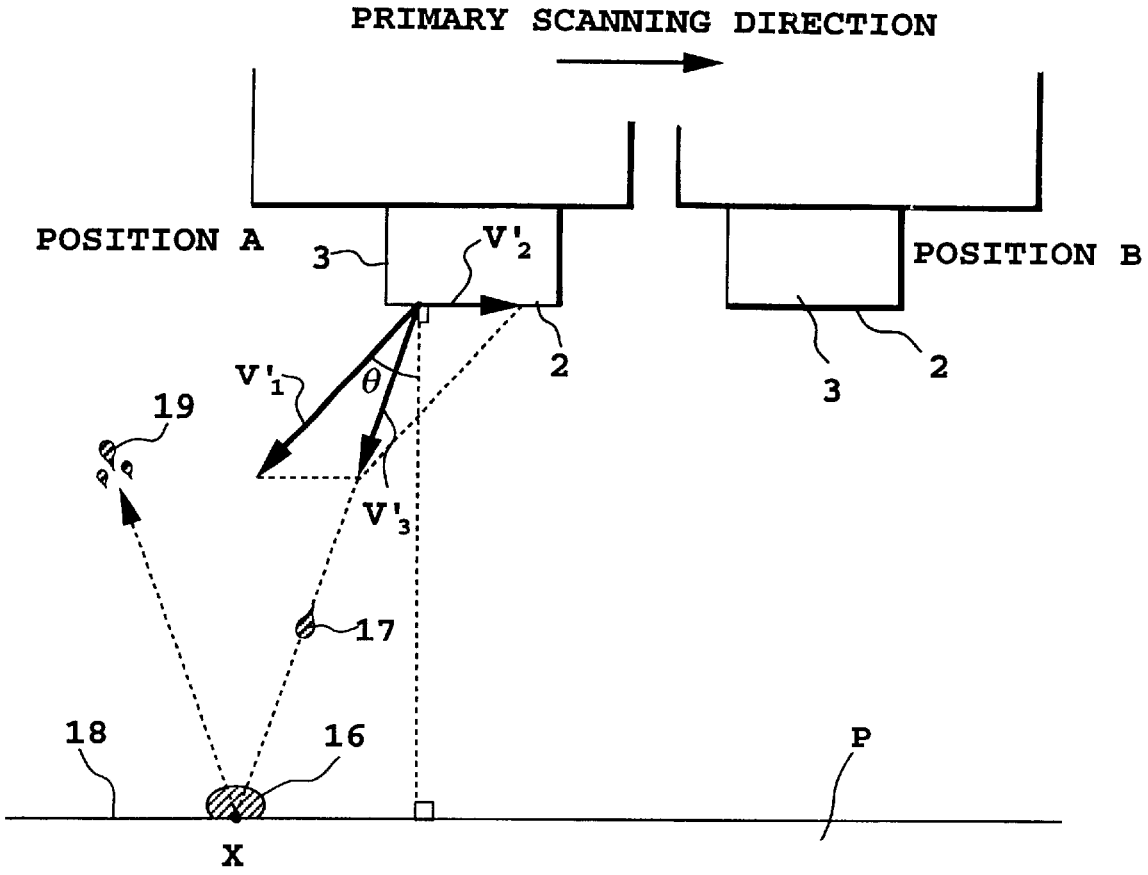
FIG. 5 is a front view describing the behavior of a splashing liquid droplet in the ink jet print apparatus according to this invention shown in FIG. 3 if an ink and a processing liquid are ejected in such a way that they are deposited on each other.

The resolution, drive condition, and printing density of the ink jet head shown in FIG. 5 and the distance between the head and the printing medium are similar to those shown in FIG. 4. At position A shown in FIG. 5, the processing liquid droplet 16 is ejected at an ejection velocity V 1' of 12 m/s in the direction tilted at an angle θ (=30°) from the perpendicular direction opposite to the primary scanning direction relative to the head from the first ejection port array 14 to deposit on the printing medium P at position X at 144 μsec later from the ejection. Then, at 31250 μsec after the ejection of the processing liquid droplet 16, the head is moved over the spacing distance between the first ejection port array 14 and the second ejection port array 15, and at the same position as the first ejection port array 14 that has ejected the processing liquid droplet 16, the black ink droplet 17 is ejected from the second ejection port array 15. The ejection direction and velocity of the black ink droplet 17 is the same as in the processing liquid droplet 16, so the black ink droplet 17 deposits on the printing medium P at position X at 144 μsec after the ejection from the second ejection port array 15.

In this case, if the scanning speed of the head V2'=0.4064 m/s, the ejection direction of the black ink droplet 17 relative to the printing medium P is shown as V'3 in the figure by synthesizing velocity vector components V'1 and V'2 together, and the black ink droplet 17 deposits on the processing liquid droplet 16 at 61.7° relative to the printing medium P at 31250 μsec after the depositing of the processing liquid droplet. This depositing causes the ink splashing droplet to splash at 61.7° relative to the printing medium P, and when the splashing droplet 19 reaches the height of the face 2 of the head, the head 3 has moved to position B that advances 1732 μm from its original position in the primary scanning direction as shown in FIG. 5, thereby preventing the splashing droplet from depositing on the face 2.

As described above, this embodiment provides the ink jet head having the two ejection port arrays corresponding to the ink and processing liquid wherein the ink splashing direction can be deviated from the face of the head by ejecting the ink droplet and processing liquid droplet so as to have a velocity vector in the direction opposite to the scanning direction of the head and thereby changing the angle at which the ink droplet deposits.

As a result, the splashing ink and processing liquid can be!prevented from depositing on the face of the head in order to appropriately reduce the occurrence of ejection errors using the simple configuration.

Second Embodiment

Unlike the first embodiment, in this embodiment, only the ejection direction of the black ink toward the direction opposite to the primary scanning direction is tilted and the ejection positions of the processing liquid and black ink are different from each other.

Under the same drive conditions as in the first embodiment, the processing liquid droplet 16 is ejected from the first ejection port array 14 in the perpendicular direction relative to the head at an ejection velocity of 12 m/s. Thus, at 125 μsec later, the droplet 16 deposits at position X on the printing medium P as shown in FIG. 5. Then, the ejection angle (θ in FIG. 5) of the black ink droplet is set at 15.0° so that the black ink droplet is ejected when the head is further moved from the ejection position of the proceeding liquid droplet in the primary scanning direction. As a result, when the splashing droplet 19 reaches the height of the face 2 of the head 3, the head 3 has moved 803.8 μm from the ejection position of the black ink in the primary scanning direction, thereby preventing the splashing droplet from depositing on the face 2. In addition, the difference in depositing time between the processing liquid and the black ink at position X of the printing medium P is 32235 μsec. This depositing time difference is 985 μsec longer than that in the conventional head or the above embodiment.

Furthermore, if the ejection angle of the black ink droplet (θ in FIG. 5) is set at 30.0° with the ejection angle of the processing liquid droplet unchanged (perpendicular to the head), when the splashing droplet 19 reaches the height of the face 2 of the head, the head 3 has moved 1732 μm from the ejection position of the black ink in the primary scanning direction, thereby preventing the splashing droplet from depositing on the face of the ink jet head. In addition, the difference in depositing time between the processing liquid and the black ink at position X of the printing medium P is 33362 μsec. This depositing time difference is 2112 μsec longer than that in the conventional head or the above embodiment.

In this manner, by setting the ejection angle (θ) of the black ink droplet at a larger value, the depositing time difference can be increased to correspondingly enable the processing liquid to fully permeate through the printing medium in order to reduce the later splashing of the dot of the depositing black ink droplet.

As is apparent from the description of each embodiment, the application of this invention is not limited to the use of the processing liquid but this invention is obviously applicable to, for example, a color print apparatus that ejects various inks so that they are deposited on one another.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black Ink K2]

The following materials are poured in a batch type vertical sand mill (manufactured by Aimex Co.), glass beads each having a diameter of 1 mm is filled as media using anion based high molecular weight material P−1 (aqueous solution containing a solid ingredient of styrene methacrylic acid ethylacrylate of 20% having an acid value of 400 and average molecular weight of 6000, neutralizing agent:potassium hydroxide) as dispersing agent to conduct dispersion treatment for three hours while water-cooling the sand mill.

After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

(Composition of Carbon Black Dispersing Element)

| | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow Ink Y2]

Anionic high molecular P−2 (aqueous solution containing a solid ingredient of 20% of stylen-acrlylic acid methyl methaacrylate having an acid value of 280 and an average molecular weight of 11,000, neutralizing agent:diethanolamine) is used as a dispersing agent and dispersive treatment is conducted in the same manner as production of the black ink K2 whereby yellow color dispersing element having a weight-average grain size of 103 nm is produced.

(Composition of Yellow Dispersing Element)

| | |
|---|---|
| P-2 aqueous solution (having a solid ingredient of 20%) | 35 parts |
| C. I. pigment yellow 180 (tradename: Nobapalm yellow PH-G, manufactured by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan Ink C2]

Cyan colored-dispersant element having a weight-average grain size of 120 nm is produced by using the anionic high molecular P−1 used when producing the black ink K2 as dispersing agent, and moreover, using the following materials by conducting dispersing treatment in the same manner as the carbon black dispersing element.

(Composition of Cyan Colored-dispersing Element)

| | |
|---|---|
| P-1 aqueous solution (having solid ingredient of 20%) | 30 parts |
| C. I. pigment blue 153 (tradename: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta Ink M2]

Magenta color dispersing element having a weight-average grain size of 115 nm is produced by using the anionic high molecular P−1 used when producing the black ink K2 as dispersing agent, and moreover, using the following materials in the same manner as that in the case of the carbon black dispersing agent.

(Composition of the Magenta Colored Dispersing Element)

| | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. A drive signal in the form of a pulse, such as those described in U.S. Pat. Nos. 4,463,359 and 4,345,262, is preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, according to this invention, at least one of the velocity vectors of the liquids sequentially ejected from the at least two ejection ports in the ink jet head as the ink jet head is scanned has a component of the velocity vector in the direction opposite to the scanning direction. Thus, the direction in which the subsequently ejected liquid is ejected can be tilted toward the direction opposite to the scanning direction relative to the printing medium, thereby enabling a splashing liquid caused by the depositing on an already deposited liquid droplet of the subsequent liquid droplet, to be directed away from the ink jet head.

As a result, a splashing ink can be prevented from depositing on the face of the head, particularly, near the ejection port to enable appropriate ink ejection in order to print high-grade images.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet print apparatus using an ink jet head that ejects different liquids, which are an ink and a processing liquid, from at least two ejection ports to allow the different liquids sequentially ejected from the at least two ejection ports while the ink jet head and a printing medium are relatively moved to deposit on the printing medium in such a way that the ejected different liquids are deposited on one another on the printing medium for printing, wherein a velocity vector of one of the different liquids ejected from at least one port for subsequent ejection of the at least two ejection ports while relatively moving the ink jet head and the printing medium has a velocity vector component in a direction opposite to the moving direction of the ink jet head relative to the printing medium and has the velocity vector component in the direction opposite to the moving direction larger than the velocity vector component of the liquid first ejected from the at least one ejection port while relatively moving the ink jet head and the printing medium.

2. An ink jet print apparatus as claimed in claim 1, wherein due to the structure of the ink jet head, the velocity vector of the liquid ejected from at least one of the at least two ejection ports has the velocity vector component in the direction opposite to the moving direction.

3. An ink jet print apparatus as claimed in claim 2, wherein the ejection direction of the liquid from the at least two ejection ports is tilted toward a direction orthogonal to a surface including the ejection ports.

4. An ink jet print apparatus as claimed in claim 1, wherein the at least two ejection ports are spaced along the moving direction of the ink jet head relative to the printing medium.

5. An ink jet printing apparatus as claimed in claim 1, wherein the ink jet head uses thermal energy to generate bubbles in ink in order to allow the ink to be ejected using pressure of the bubbles.

6. An ink jet print apparatus as claimed in claim 1, wherein the velocity vector is a composite vector during relative movement between the ink jet head and the printing medium.

7. An ink jet print method for printing using an ink jet head that ejects different liquids, which are an ink and a processing liquid, from at least two ejection ports to allow the different liquids sequentially ejected from the at least two ejection ports while the ink jet head and a printing medium are relatively moved to deposit on the printing medium in such a way that the ejected different liquids are deposited on one another on the printing medium, wherein the velocity vector of one of the different liquids ejected from at least one port for subsequent ejection of the at least two ejection ports while relatively moving the ink jet head and printing medium has a velocity vector component in a direction opposite to the moving direction of the ink jet head relative to the printing medium and has the velocity vector component in the direction opposite to the moving direction larger than the velocity vector component of the liquid first ejected from the at least one ejection port while relatively moving the ink jet head and the printing medium.

8. An ink jet print method as claimed in claim 7, wherein the ink is ejected from one of the at least two ejection ports, and the processing liquid for making color material in the ink insoluble or aggregate is ejected from another port.

9. An ink jet print method as claimed in claim 7, wherein the velocity vector is a composite vector during relative movement between the ink jet head and the printing medium.

* * * * *

UNITED STATES PATENT AND TRADEMARK OFFICE

CERTIFICATE OF CORRECTION

PATENT NO. : 6,467,894 B1
DATED : October 22, 2002
INVENTOR(S) : Yoshinor Misumi It is certified that error appears in the above-identified patent and that said Letters Patent is hereby corrected as shown below:

Column 3,
Line 38, “aggregation.” should read -- aggreate. --.

Column 4,
Lines 40 and 42, “nano-grams” should read -- nanograms --.
Lines 41 and 43, “is” should read -- are --.
Line 51, “fuloropore” should read -- Fluoropore --.

Column 5,
Line 19, “Fuloroporefilter,” should read -- Fluoropore filter, --.

Column 6,
Line 22, “attainted” should read -- attained --.
Line 27, “so” should read -- so- --.

Column 7,
Line 5, “has” should read -- has been --.
Line 6, “deposits” should read -- is deposited --.
Line 61, “be!prevented” should read -- be prevented --.

Column 8,
Line 61, “is” should read -- are --.
Line 65, “agent:po-” should read -- agent: po- --.

UNITED STATES PATENT AND TRADEMARK OFFICE

CERTIFICATE OF CORRECTION

PATENT NO. : 6,467,894 B1
DATED : October 22, 2002
INVENTOR(S) : Yoshinor Misumi It is certified that error appears in the above-identified patent and that said Letters Patent is hereby corrected as shown below:

Column 9,
Line 22, “stylen-acrylic” should read -- styrene-acrylic --.
Line 23, “methaacrylate” should read -- methacrylate --.
Line 25, “agent:diethanolamine)” should read -- agent: diethanolamine --.
Line 37, “triethylen” should read -- triethylene --.
Line 38, “diethylenglycol” should read -- diethylene glycol --.

Signed and Sealed this

Twenty-second Day of April, 2003

JAMES E. ROGAN
*Director of the United States Patent and Trademark Office*